US005372167A

United States Patent [19]

Hirose et al.

[11] Patent Number: 5,372,167

[45] Date of Patent: Dec. 13, 1994

[54] FILLING MACHINE

[75] Inventors: Hideaki Hirose; Shigeru Yoshida, both of Ishikawa, Japan

[73] Assignee: Shibuya Kogyo Co., Ltd., Ishikawa, Japan

[21] Appl. No.: 47,806

[22] Filed: Apr. 15, 1993

[30] Foreign Application Priority Data

| | | | |
|---|---|---|---|
| Jul. 2, 1992 | [JP] | Japan | 4-199267 |
| Jul. 2, 1992 | [JP] | Japan | 4-199268 |
| Oct. 20, 1992 | [JP] | Japan | 4-306439 |
| Oct. 20, 1992 | [JP] | Japan | 4-306440 |

[51] Int. Cl.[5] ..... B65B 31/00

[52] U.S. Cl. ..... 141/39; 141/146; 141/260; 141/275; 141/266; 141/47; 141/55; 141/181

[58] Field of Search ..... 141/39, 40, 41, 43, 141/146, 147, 260, 263, 275, 266, 47, 48, 50, 51, 55, 57, 135, 136, 137, 144, 145, 146, 147, 148, 149, 150, 156, 157, 181, 5, 6, 152

[56] References Cited

U.S. PATENT DOCUMENTS

| | | | |
|---|---|---|---|
| 2,839,094 | 6/1958 | Reno | 141/146 |
| 3,172,436 | 3/1965 | Wilhere et al. | 141/146 |
| 3,430,668 | 3/1969 | Risenberg | 141/260 |
| 4,319,613 | 3/1982 | Mette | 141/147 |
| 4,467,846 | 5/1984 | Croser | 141/47 |
| 4,989,650 | 2/1991 | Weiss | 141/47 |

FOREIGN PATENT DOCUMENTS

| | | |
|---|---|---|
| 58-52914 | 11/1983 | Japan . |
| 62-8998 | 1/1987 | Japan . |
| 2-117390 | 1/1990 | Japan . |
| 3-43500 | 4/1991 | Japan . |

*Primary Examiner*—Henry J. Recla
*Assistant Examiner*—Steven O. Douglas
*Attorney, Agent, or Firm*—Flynn, Thiel, Boutell & Tanis

[57] ABSTRACT

A cylindrical housing 6 is secured to the bottom surface of an elevatable filling liquid tank 2, and a liquid injection pipe 16 is mounted on the bottom of the housing 6. An exhaust pipe 18 axially passes through the housing 6 and the liquid injection pipe 16, and is disposed for elevating movement. The exhaust pipe 18 is driven by an elevating mechanism 21. A holder 54 carrying a bottle mouth stuffing 52 is fitted in the housing 6, and is urged down by a spring 61. The bottle mouth stuffing 52 tightly engages the mouth of a vessel which is being raised as carried on a vessel receptacle, and accordingly its position is determined by the height of the vessel. The position of the liquid injection pipe 16 and the exhaust pipe 18 is modified in accordance with the elevation of the tank 2, independently from the bottle mouth stuffing 52. Accordingly, a void which remains in the top of the vessel after the vessel is filled with the liquid is adjusted only in accordance with the elevation of the tank 2.

10 Claims, 8 Drawing Sheets

FILLING MACHINE

BACKGROUND OF THE INVENTION

The invention relates to a filling machine for filling a vessel with a liquid, and more particularly, to a filling machine provided with a liquid level adjusting controller which is capable of adjusting a liquid level or filling height in a vessel, that is, which is capable of adjusting the volume of a void which remains in the top of a vessel after it has been filled.

A filling machine generally comprises a rotatable tank containing a supply of a liquid to be filled, a plurality of filling heads disposed around the bottom of the tank toward the outer periphery at an equal circumferential spacing, and an elevatable vessel receptacle located below each head for placement of a vessel thereon. A conventional filling head comprises a liquid injection pipe which is disposed to be elevatable within the tank so that when it moves upward, it opens a liquid valve to allow a filling of a vessel with a liquid, a bottle mouth stuffing integrally elevatable with the injection pipe so as to be tightly engaged with the mouth of the vessel to seal it, and an exhaust pipe for externally exhausting an air from within the vessel when it is filled with a liquid.

In a filling machine constructed in the manner mentioned above, when the mouth of a vessel which is raised upward by means of the vessel receptacle tightly engages the bottle mouth stuffing to raise it, the liquid injection pipe which is integral with the bottle mouth stuffing is also forced upward, whereupon a liquid injection port (liquid valve) formed in the bottom of the exhaust pipe and an exhaust port (air valve) are opened to allow a filling of the vessel. The arrangement is such that the exhaust pipe is inserted into the vessel to a given depth so that when the liquid fills the vessel to the elevation of the exhaust port formed in the bottom of the exhaust pipe, the liquid to be filled rises inside the exhaust pipe to complete a filling operation when it reaches the liquid level within the tank. In this manner, a void or space is left within the vessel which corresponds to a difference in elevation between the mouth of the vessel and the location of the exhaust port of the exhaust pipe which is inserted into the vessel.

To change the volume of the void left within the vessel, the depth to which the exhaust pipe is inserted into the vessel may be changed. In other words, it is only necessary that a relative position between the bottle mouth stuffing which tightly engages the mouth of the vessel and moves upward together with the vessel, and the exhaust pipe be changed. Such a liquid level adjusting controller for a filling machine has already been proposed. For example, see Japanese Laid-Open Utility Model Application No. 8998/1987 where the relative position between the exhaust pipe and the bottle mouth stuffing is changed by manually changing a spacer or Japanese Laid-Open Utility Model Application No. 43500/1991 where the connection between the bottle mouth stuffing and the liquid injection pipe is disengaged by a manual operation, the tank is elevated, a cleaning cup is utilized to raise the bottle mouth stuffing through a given stroke, and then the bottle mouth stuffing and the liquid injection pipe are locked together again.

A conventional liquid level adjusting controller as mentioned above is either manual or semi-automatic in operation, and thus requires a manual operation, which is troublesome and time consuming. In addition, a known controller only permits a stepwise change among predetermined elevations, but fails to provide a stepless adjustment. The present applicant has previously proposed a liquid level adjusting controller which enables a stepless adjustment to be made automatically (see Japanese Utility Model Application No. 117390/1990). In this liquid level adjusting controller, an air lock mechanism is released and the connection between the liquid injection pipe and the bottle mouth stuffing is disengaged. Subsequently, a cleaning cup is inserted between the bottle mouth stuffing and the vessel receptacle which is located therebelow. The tank which contains a supply of a filling liquid is then lowered to cause the bottle mouth stuffing to be forced up by means of the cleaning cup, thereby changing the elevation of the bottle mouth stuffing relative to the exhaust pipe which is secured to the tank. The air lock mechanism is then again operated to lock such relative elevation.

The automatic liquid level adjusting controller thus constructed eliminates the need for a manual operation to improve the working efficiency, but still requires a withdrawal of the cleaning cup. In addition, if it is found necessary, during the operation of the filling machine, to change the volume of the void by a small amount, such change cannot be achieved in a simple manner.

In the filling machine constructed as mentioned above, the arrangement is made such that when the liquid filling the vessel reaches the exhaust port of the exhaust pipe and then rises within the exhaust pipe until it reaches the liquid level within the tank to complete a filling operation, the liquid valve and the air valve are closed under this condition. Accordingly, a residue of the filling liquid remains within the exhaust pipe upon completion of the filling operation. Accordingly, when the liquid valve and the air valve are opened for the next time the filling operation takes place, an exhaust passage within the exhaust pipe remains blocked, and accordingly a filling of the liquid cannot take place until such residue is discharged and the exhaust passage recovers its intended function. In addition, if the filling operation takes place, the flow rate is greatly retarded.

To accommodate for this, a filling machine has already been proposed (see Japanese Patent Publication No. 52914/1983) which is provided with a negative pressure chamber which causes a negative pressure to be produced in the top of the exhaust pipe so that a channel path be secured for the air which is exhausted from within the vessel during a filling operation, by discharging the residue of liquid which remains within the exhaust pipe at the commencement of the filling operation or if such discharge cannot be assured completely, by disrupting a stabilized condition for the residue of liquid within the exhaust pipe. The negative pressure chamber is defined by a plunger which is secured to the liquid injection pipe and which is slidably and tightly fitted in the top end of the exhaust pipe. When the plunger moves upward together with the liquid injection pipe, the volume within the exhaust pipe increases to produce a negative pressure, and as the plunger rises further upward, a communication is established between the top space within the exhaust pipe and a top space within the tank, withdrawing the filling liquid which remains within the liquid pump for discharge into the tank.

The described arrangement for discharging a residue of liquid which remains within the exhaust pipe for a filling machine constructed in the manner mentioned above involves difficulties causes by the use of the plunger in that it is unfavorable in sanitary respect and disadvantageous in cost considerations.

SUMMARY OF THE INVENTION

It is therefore an object of the invention to provide a filling machine having a liquid level adjusting controller which is capable of adjusting the volume of a void only through the elevating movement of a tank containing a supply of liquid to be filled, without using devices such as a cleaning cup.

Such object is accomplished in accordance with the invention by providing a filling machine with a liquid level adjusting controller, comprising a tank containing a supply of a liquid to be filled, a tubular body secured to the bottom surface of the tank and having an internal liquid channel path formed therein, an exhaust pipe elevatably disposed within the tubular body and also having an internal exhaust passage formed therein, means for elevating the exhaust pipe, a liquid injection pipe mounted on the bottom of the tubular body, a liquid valve and an air valve mounted in the bottom of the exhaust pipe and adapted to be opened or closed in response to an elevating movement of the exhaust pipe relative to the liquid injection pipe, a holder mounted to be elevatable with respect to the tubular body and having a bottle mouth stuffing mounted on its lower end, means for urging the holder downward, means for raising a vessel to bring its mouth into abutment against the bottle mouth stuffing, and means for elevating the tank.

In this liquid level adjusting controller, the bottle mouth stuffing is elevatable relative to the liquid injection pipe and the exhaust pipe which are mounted on the bottom of the tubular body and within the tubular body, respectively. The elevation which the bottle mouth stuffing assumes during a filling operation is determined by the mouth of a vessel which is raised by the vessel receptable, while the elevation of the liquid injection pipe and the exhaust pipe is determined by the elevating movement of the tank and independently from the elevation which the bottle mouth stuffing assumes during a filling operation. In this manner, the volume of a void within the vessel is controlled only by the elevating movement of the tank.

It is a second object of the invention to provide a filling machine with an arrangement which allows a rapid discharge of a residue of filling liquid which remains within the exhaust pipe before the commencement of a next filling operation, without the use of a negative pressure generating mechanism which utilizes a plunger.

This object is accomplished in accordance with the invention by providing a filling machine with an arrangement for discharging a residue of filling liquid which remains within an exhaust pipe, comprising a tank containing a supply of a filling liquid, a tubular body secured to the bottom surface of the tank and having an internal liquid channel path formed therein, an exhaust pipe elevatably disposed within the liquid channel path of the tubular body and also having an internal exhaust passage formed therein, means for elevating the exhaust pipe, a liquid injection pipe mounted on the bottom of the tubular body, a liquid valve and an air valve mounted in the bottom of the exhaust pipe and which are opened or closed in response to the elevating movement of the exhaust pipe relative to the liquid injection pipe, a holder disposed to be elevatable with respect to the tubular body and having a bottle mouth stuffing mounted on its lower end, means for urging the holder downward, and means for elevating a vessel to bring the mouth of the vessel into abutment against the bottle mouth stuffing, the arrangement being such that during a filling operation of a vessel, the exhaust pipe is lowered to open the both valves, and then the urging means operates to urge the holder downward to cause the bottle mouth stuffing to be tightly engaged with the mouth of the vessel, in delayed relationship to the timing of the valve opening.

In the filling machine which is provided with the described arrangement for discharging a residue of liquid which remains within the exhaust pipe, the bottle mouth stuffing is not disposed in abutment against the mouth of the vessel at the time the liquid valve is opened to initiate a filling operation, so that the air in the vessel is free to find its way out, whereby the filling operation can take place immediately if the exhaust passage has been blocked and any liquid which remains within the exhaust pipe is allowed to drop into the vessel in a rapid manner.

DETAILED DESCRIPTION OF EMBODIMENTS

Figure 1:
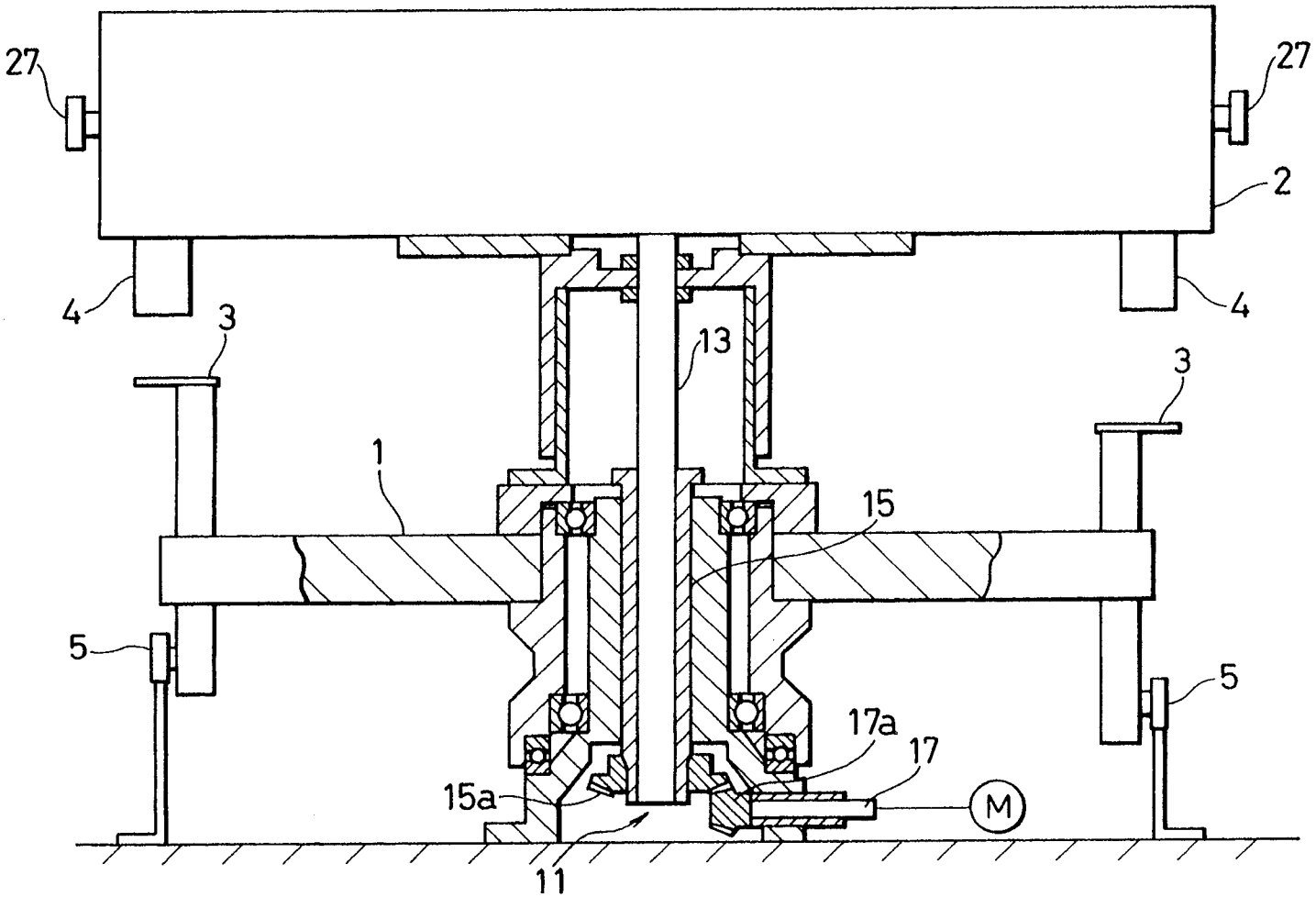
FIG. 1 is a longitudinal section of a filling machine with a liquid level adjusting controller according to one embodiment of the invention.

Referring to the drawings, several embodiments of the invention will now be described. Initially referring to FIG. 1, a filling machine includes a turntable 1 which is driven for rotation by a drive source, not shown, a tank 2 containing a supply of a filling liquid and disposed above the turntable 1 for integral rotation therewith, a plurality of filling heads 4 mounted on the bottom surface of the tank 2 toward its outer periphery at an equal circumferential spacing, and a vessel receptacle 3 disposed below each filling head 4 and elevatable as actuated by an associated cam 5 while rotating together with the filling head 4.

The tank 2 is arranged to be integrally rotatable with the turntable 1 and is also elevatable with respect to the turntable 1 by means of a tank elevating mechanism 11. The tank elevating mechanism 11 comprises a vertically extending threaded shaft 13 which is secured centrally in the bottom of the tank 2, a nut 15 rotatably carried by the central portion of the turntable 1 for threadable engagement with the threaded shaft 13, a bevel gear 15*a* formed around the bottom of the nut 15, a horizontal rotary shaft 17 driven for rotation by a motor M, and a bevel gear 17*a* fixedly mounted on the horizontal rotary shaft 17 for meshing engagement with the bevel gear 15*a*. As the motor M is set in motion, its drive is transmitted through the engaging bevel gears 15*a*, 17*a* to rotate the nut 15, whereby the threaded shaft 13 is elevated, causing in turn an elevating movement of the tank 2.

Figure 3:
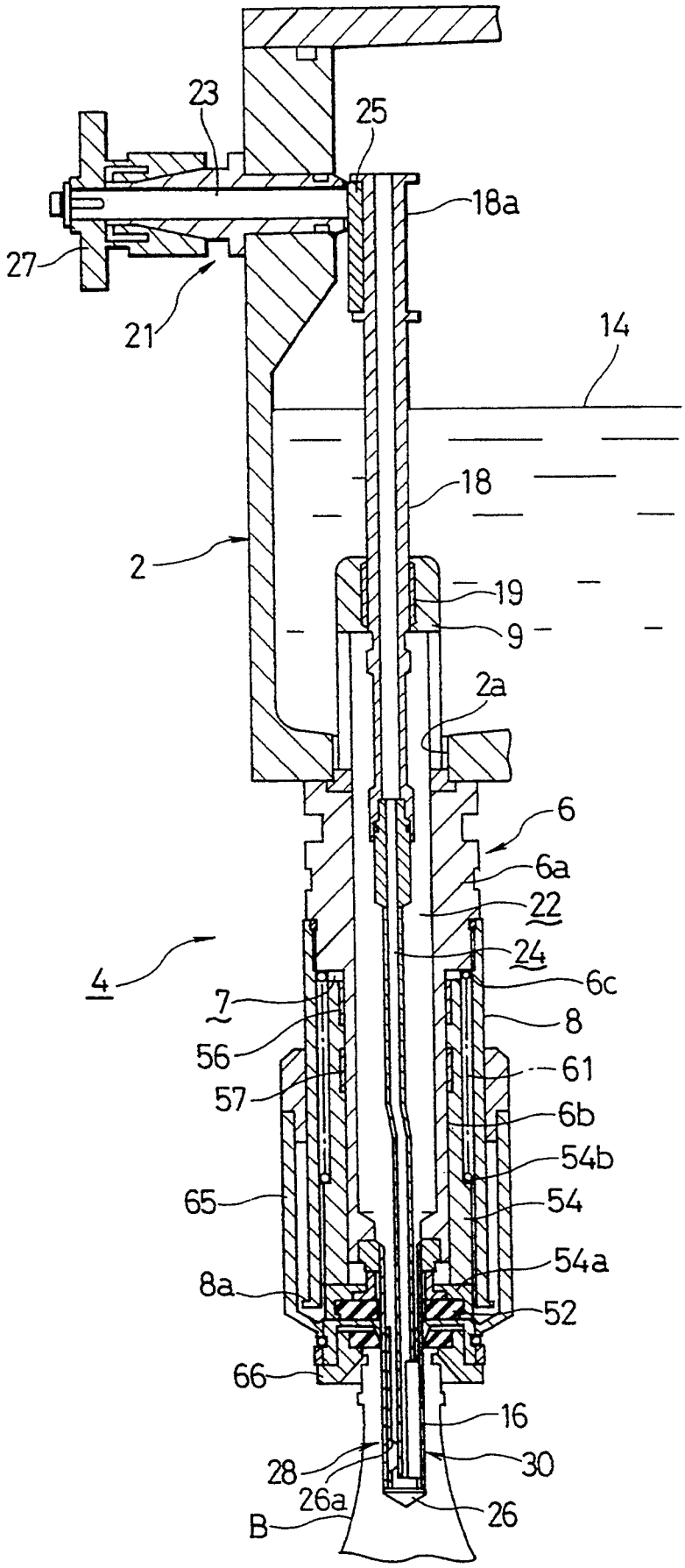
FIG. 3 is a longitudinal section of one form of filling head.

Referring to FIG. 3, the construction of the filling head 4 will be described in detail. It is to be understood that FIG. 3 illustrates a condition which it assumes immediately before the commencement of the filling operation when a vessel B is raised upward. Toward its outer periphery, the bottom surface of the tank 2 is formed with a through-opening 2*a*. A pair of cylindrical housings 6, 8 which are coupled together are secured to the bottom surface of the tank or below the through-opening 2*a*, while a support sleeve 9 is fixedly mounted within the through-opening 2*a* to extend into the tank 2 in an upright manner. The upper housing 6 includes a top portion 6*a* having a peripheral surface of an increased diameter, and a bottom portion 6*b* of a reduced diameter which extends into the lower housing 8. The lower housing 8 is secured to the lower end of the top portion 6*a* of the upper housing 6, defining a clearance 7 between the internal surface of the lower housing 8 and the external surface of the bottom portion 6*b* of the upper housing 6. A liquid injection pipe 16 is fixedly connected to the lower end of the upper housing.

An exhaust pipe 18 extends through the support sleeve 9, the upper housing 6 and the liquid injection pipe 16, and is supported in an elevatable manner by means of a slide bushing 19 which is fitted inside the support sleeve 9. The top of the exhaust pipe 18 extends upward within the tank 2 to project above a liquid level 14 of the filling liquid, and the pipe is elevated by an exhaust pipe elevating mechanism 21 which will be described later. A filling liquid channel path 22 is defined between the external surface of the exhaust pipe 18 and the internal surfaces of the upper housing 6 and the liquid injection pipe 16 while an exhaust passage 24 is defined within the exhaust pipe 18. Accordingly, in the present embodiment, the upper housing 6 functions as a liquid injection tube.

A nozzle 26 of a greater diameter than the exhaust pipe 18 is attached to the lower end of the exhaust pipe 18 and is fitted inside the liquid injection pipe 16 for sliding movement therin. The nozzle 26 is formed with a liquid injection port 26*a* and an exhaust port (not shown), with the liquid injection port 26*a* communicating with the liquid passage 22 and the exhaust port communicating with the exhaust passage 24. The combination of the nozzle 26 and the liquid inection pipe 16 secured to the exhaust pipe 18 constitutes a liquid valve 28 which opens or closes the liquid injection port 26*a* and an air valve 30 which opens or closes the exhaust port. When the exhaust pipe 18 is lowered relative to the liquid injection pipe 16 which is secured to the tank 2 through the upper housing 6, the liquid valve 28 and the air valve 30 are both opened, while when the exhaust pipe 18 is raised, the both valves 28, 30 are closed.

Figure 2:
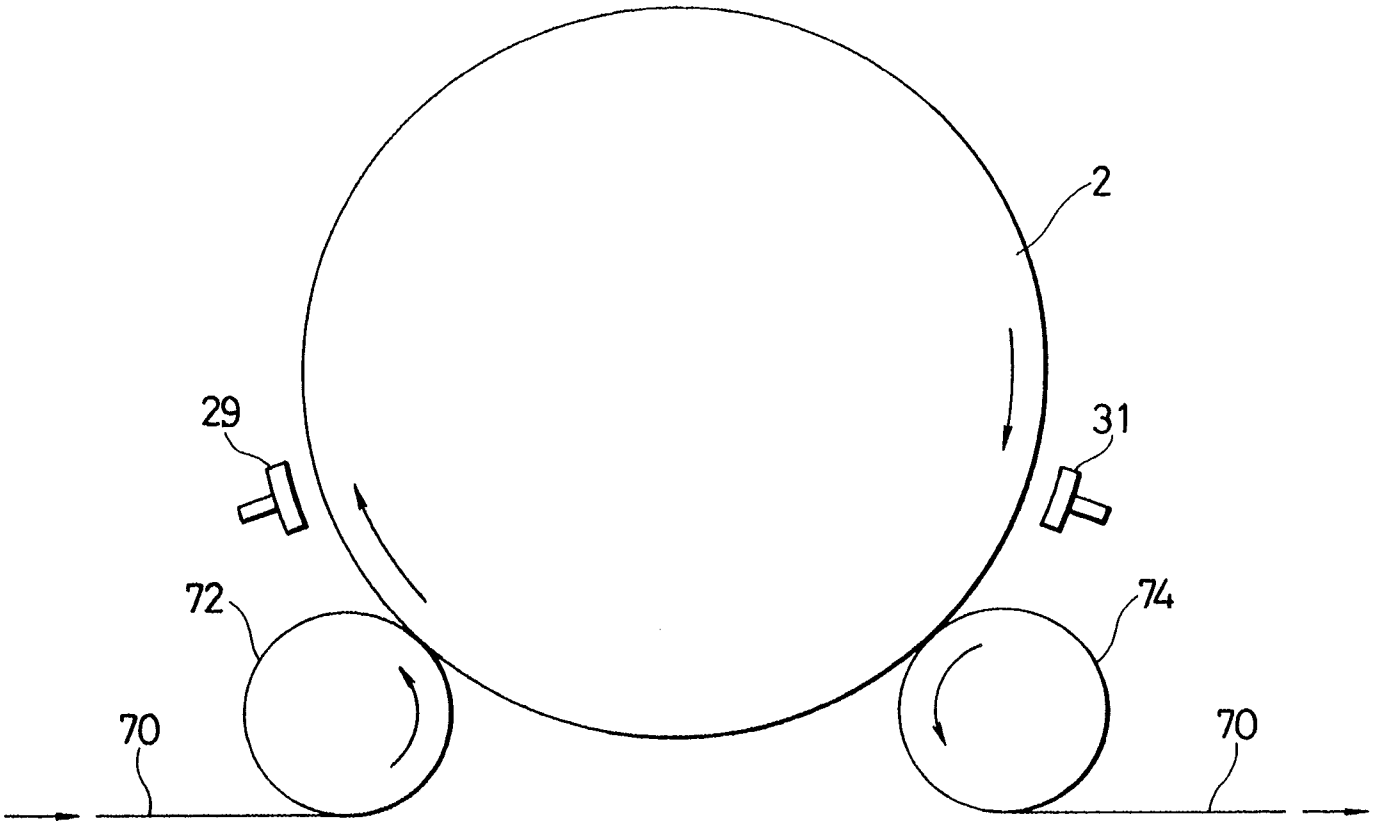
FIG. 2 is a schematic plan view of the filling machine.

The elevating mechanism 21 which elevates the exhaust pipe 18 up and down comprises a horizontal rotary shaft 23 which is journalled by extending through a side wall of the tank 2 toward its top, an elevating lever 25 mounted on the end of the rotary shaft 23 which is disposed inside the tank 2 for engaging a mating portion 18*a* which is formed on the upper end of the exhaust pipe 18, and an operating lever 27 which is fixedly mounted on a portion of the rotary shaft 23 located outside the tank. When the operating lever 27 is turned in one direction by interacting with an upstream, first fixed cam 29 (see FIG. 2) which is disposed around a path of rotation of the tank 2, the elevating lever 25 is turned to depress its engaging exhaust pipe 18, and when the operating lever 27 is rotated in the opposite direction by interacting with a downstream, second fixed cam 31, the operating lever 25 is turned upward to pull up the exhaust pipe 18 to its original position. It should be understood that means for elevating the exhaust pipe 18 is not limited to the arrangement shown, but many other well-known means may be used such as an actuator.

A cylindrical holder 54 having a bottle mouth stuffing 52 mounted on its lower end is fitted in the clearance 7 defined between the outer peripheral surface of the bottom portion 6*b* of the upper housing 6 and the internal peripheral surface of the lower housing 8, so as to slide over the external surface of the bottom portion 6*b* of the upper housing 6 through the interposed slide bushings 56, 57 disposed into the cylindrical holder 54. A lower portion 54*a* of the cylindrical holder 54 on which the bottle mouth stuffing 52 is mounted slides along the external surface of the liquid injection pipe 16. On its outer surface, the cylindrical holder 54 is formed with a step 54*b*, and a step 6*c* is also formed between the top portion 6*a* and the bottom portion 6*b* of the upper housing 6. A spring 61 is disposed between the both steps to urge the cylindrical holder 54 down normally. When inoperative, the cylindrical holder 54 as urged by the spring 56 remains at rest with the bottle mouth stuffing 52 abutting against the upper surface of a guide cone 66 which will be described later.

An elevating sleeve 65 is fitted around the lower housing 8 for elevating movement. The guide cone 66 which is effective for centering the vessel B as it is being raised by the vessel receptacle 3 is mounted on the lower end of the elevating sleeve 65. The elevating sleeve 65 and the guide cone 66 are arranged such that a top portion of the elevating sleeve 65 is guided by the outer peripheral surface of the lower housing 8 while the central portion of the downwardly located guide cone 66 slides up and down along the external surface of the liquid injection pipe 16. On its bottom end and around its outer periphery, the lower housing 8 is formed with a stop 8*a*, against which the elevating sleeve 65 abuts to remain stationary as it is urged by the cylindrical holder 54 to move down when the machine is inoperative.

The operation of the filling machine constructed in the manner mentioned above will now be described. At the commencement of the filling operation, the elevating lever 25 of the exhaust pipe elevating mechanism 21 is turned upward, whereby the exhaust pipe 18 assumes its raised position, and the nozzle 26 secured to the lower end therof is received within the liquid injection pipe 16, thus closing the liquid valve 28 and the air valve 30.

The vessel B, which is conveyed on a conveyor 70 (see FIG. 2) is supplied to the one of vessel receptacles 3 within the filling machine through a supply star wheel 72. The vessel receptacle 3 begins to be raised by the action of the cam 5, and the vessel B on the receptacle 3 also rises as guided by the guide cone 66. Since the cylindrical holder 54 which holds the bottle mouth stuffing 52 is urged downward by the spring 61, as the receptacle 3 rises, the mouth of the vessel B moves through the guide cone 66 to bear against the bottle mouth stuffing 52 which is located above it, whereby the vessel B is sealed. (FIG. 3 shows a condition when the vessel B has been sealed, but immediately before the both valves 28, 30 are opened.)

As the filling head 4 reaches the location of the first fixed cam 29 which switches the exhaust pipe elevating mechanism 21 as a result of rotation of the filling machine, the operating lever 27 which is located outside the tank 2 interacts with the first fixed cam 29 to be turned thereby. The turning movement of the operating lever 27 causes the rotary shaft 23 and the elevating lever 25 to be both rotated to depress the exhaust pipe 18. When the exhaust pipe 18 and the nozzle 26 move down relative to the upper housing (liquid feed tube) 6 and the liquid injection pipe 16, the liquid valve 28 and the air valve 30 are opened. In response to the opening of the liquid valve 28, the liquid within the tank 2 begins to flow into the vessel B.

As the filling of the vessel B proceeds, and the liquid fills the liquid injection pipe 16 to the bottom thereof, the liquid then enters the exhaust port to rise through the exhaust pipe 18, and when it reaches the liquid level 14 in the tank 2, the inflow of the filling liquid into the vessel B is completed. Subsequently, the operating lever 27 of the exhaust pipe elevating mechanism 21 is turned by the second fixed cam 31, thus raising the exhaust pipe 18 through the action of the elevating lever 25. As the exhaust pipe 18 is raised, the liquid valve 28 and the air valve 30 are closed. The vessel receptacle 3 then descends, and is delivered onto the conveyor 70 through a delivery star wheel 74, thus completing the filling step.

When it is desired to adjust the volume of the void as a result of a change in a variety of the vessel being filled or a change in the amount of filling applied to the same vessel, the stroke through which the tank 2 is to be elevated is determined on the basis of the height of the vessel and the volume of the void. Accordingly, it is only necessary to elevate the tank 2 by means of the tank elevating mechanism 11. In other words, the bottle mouth stuffing 52 has no connection with, but is independent from the upper housing (liquid supply tube) 6, the liquid injection pipe 16 and the exhaust pipe 18, which constitute together the liquid valve 28 and the air valve 30, and accordingly, it is only necessary to elevate the tank 2 to cause an integral elevating movement of the upper housing 6 and the liquid injection pipe 16 secured to the tank 2, and the exhaust pipe 18 and the nozzle 26 which open the both valves 28, 30 as a result of their relative movement with respect to the liquid injection pipe 16, in order to change the distance between the mouth of the vessel and the exhaust port of the nozzle 26, which determines the volume of the void. In a conventional filling machine initially mentioned, the bottle mouth stuffing 52 which seals the mouth of the vessel is connected with the liquid supply tube 6 and the liquid injection pipe 16 which open or close the liquid injection port **26*a* and the exhaust port for integral elevating movement therewith, and accordingly, when it is desired to adjust the volume of the void, the connection between the bottle mouth stuffing 52 and the tube 6 and the pipe 16 must be once interrupted, and a cleaning cup, for example, is used to change the position of the bottle mouth stuffing 52 relative to the tube 6 and the pipe 16, and subsequently they must be connected together again. By contrast, in the arrangement of the embodiment, merely changing the elevation of the tank 2 is all that is required to change the volume of the void. Consequently, the changing operation is simple, and the time required can be reduced. In addition, a fine adjustment during the operation is facilitated. There is no need for means such as a cleaning cup which is used to raise the bottle mouth stuffing 52. Finally, the nozzle 26 which is formed with the liquid injection port 26*a*** and the exhaust port may be inserted deeply into the vessel, which is advantageous for bottles having narrowed necks.

Figure 4:
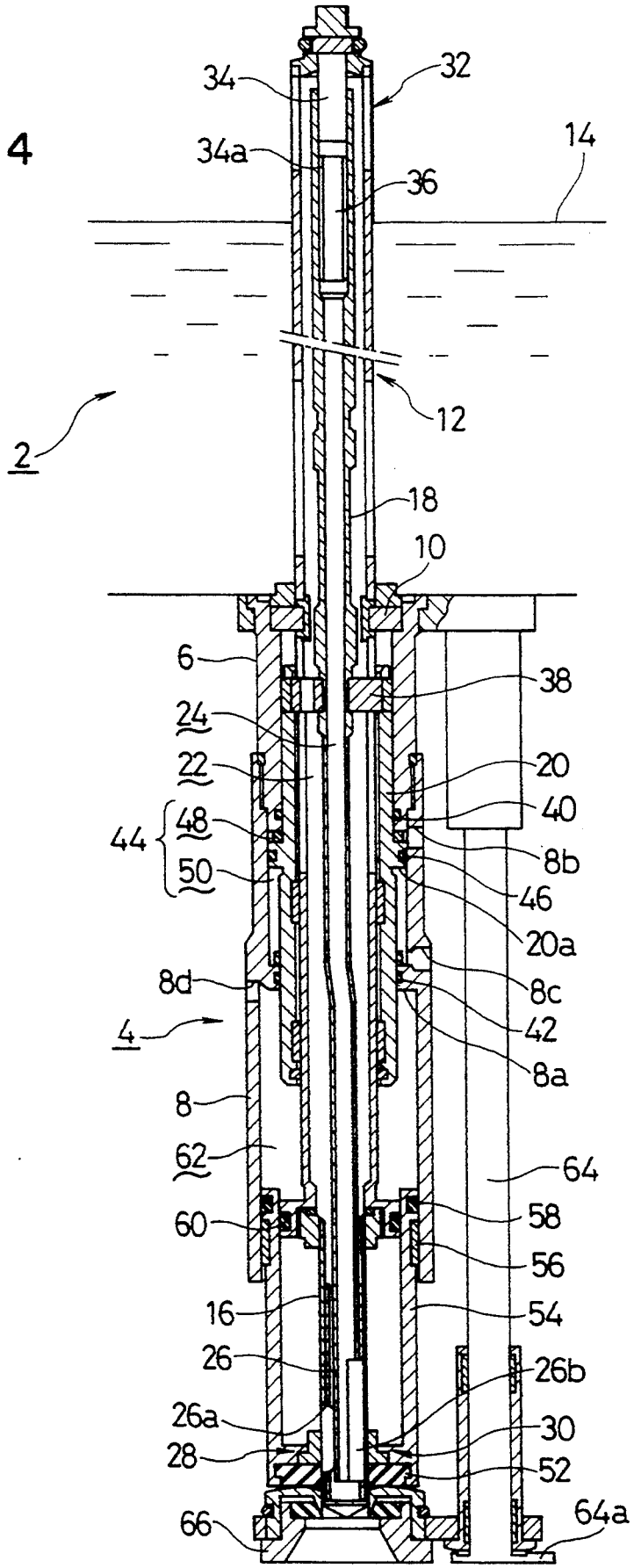
FIG. 4 is a longitudinal section of another form of filling head.

Referring to FIG. 4, the construction of another filling head 4 according to a second embodiment of the invention will be described. A pair of cylindrical housings 6, 8 which are vertically coupled together is secured to the bottom surface of the tank 2 containing a supply of a filling liquid. By utilizing a bracket 10, a liquid supply tube 12 is fixedly mounted inside the housings 6, 8. The top of the tube 12 extends upward in the tank 2 to project above a liquid level 14 of the filling liquid. A liquid injection pipe 16 of a reduced diameter is fixedly mounted in the lower end of the tube 12. An exhaust pipe 18 passes through the liquid supply tube 12 and the liquid injection pipe 16, and is connected to a cylindrical piston 20, to be described later, for integral elevating movement therewith. A filling liquid passage 22 is defined between the external surface of the exhaust pipe 18 and the internal surfaces of the liquid supply tube 12 and the liquid injection pipe 16 while the interior of the exhaust pipe 18 defines an exhaust passage 24.

A nozzle 26 of a greater diameter than the exhaust pipe 18 is attached to the lower end of the exhaust pipe 18, and is fitted inside the liquid injection pipe 16 for sliding movement therein. The nozzle 26 is formed with a liquid injection port **26*a* and an exhaust port 26*b*, the liquid injection port 26*a* communicating with the liquid passage 22 and the exhaust port 26*b* communicating with the exhaust passage 24. The nozzle 26 secured to the exhaust pipe 18 and the liquid injection pipe 16 constitute a liquid valve 28 which opens or closes the liquid injection port 26*a* and an air valve 30 which opens or closes the exhaust port 26*b*. When the exhaust pipe 18 is lowered relative to the liquid supply tube 12 and the liquid injection pipe 16 secured to the tank 2, the both valves 28, 30 are opened while when the exhaust pipe 18 is raised, the both valves 28, 30** are closed.

A negative pressure generating valve 32 is provided on the top end of the exhaust pipe 18. The valve 32 is slidably and closely fitted in the top opening of the exhaust pipe 18, and includes a plunger 34 secured to the top end of the liquid supply tube 12. Defined a lower portion the plunger 34 is a negative pressure generating chamber 36 which communicates with the exhaust passage 24 inside the exhaust pipe 18, and the chamber 36 is formed with an exhaust opening **34*a* which allows the chamber to communicate with the exterior. As the exhaust pipe 18 is raised, the exhaust opening 34*a* is sealed by the internal surface of the exhaust pipe 18. However, when the exhaust pipe 18 descends, the interior of the chamber 36 is initially decompressed, and after the liquid injection port 26*a* in the liquid valve 28 is opened, the exhaust opening 34*a* is opened simultaneously, thus allowing the air and any residue of liquid in the exhaust pipe 18 to be discharged into the tank 2** by means of the negative pressure.

The cylindrical piston 20 is fitted between the internal surfaces of the cylindrical housings 6, 8 and the external surface of the liquid supply tube 12, and has its top end fixedly connected to the exhaust pipe 18 through a connection member 38. An O-ring 40 is fitted in the internal surface of the upper housing 6 at its bottom, and the internal surface of the lower housing 8 is formed, intermediate its length, with an annular projection 8*a*, and an O-ring 42 is fitted around its inner periphery for sliding contact with the external surface of the cylindrical piston 20, thus defining a hermetically sealed space 44 between the lower end face of the upper housing 6 and the upper surface of the annular projection 8*a* of the lower housing 8. The cylindrical piston 20 is formed with an annular projection 20*a* which is situated within this space, with an O-ring 46 fitted around its outer periphery to divide the space 44 into a pair of upper and lower pressure chambers 48, 50. The sidewall of the lower housing 8 is formed with air inlet ports 8*b*, 8*c* which communicate with the pressure chambers 48, 50, respectively, and which are connected to an air source, not shown, and the air is introduced into one of the both pressure chambers 48, 50 while the other is released to cause an elevating movement of the cylindrical piston 20 and hence that of the exhaust pipe 18 connected thereto.

A cylindrical holder 54 having a bottle mouth stuffing 52 mounted on its lower end is fitted around a lower portion of the lower housing 8 which is located below the annular projection 8*a* and carries a slide bushing 56 which slides along the internal surface of the lower housing 8. A seal ring 58 is mounted on the external surface of the cylindrical holder 54, and another seal ring 60 is mounted on the outer periphery of the liquid supply tube 12 at its lower end for sliding contact with the internal surface of the holder 54. The lower housing 8, the liquid supply tube 12, the cylindrical piston 20 and the cylindrical holder 54 constitute together an air inlet chamber 62. The air inlet chamber 62 is also connected to an air source, not shown, through an air inlet port 8*d* formed in the lower housing 8. A low pressure air is introduced into the air inlet chamber 62 to maintain the bottle mouth stuffing 52 urged downward through the cylindrical holder 54 so that the mouth of a vessel which is being raised by means of the vessel receptacle can be held in tight engagement therewith.

A guide rod 64 is secured to the bottom surface of the tank 2 adjacent to the filling head 4 and depends vertically downward. A guide cone 66 which is used for centering a vessel as it is being carried upward on the vessel receptacle is elevatably mounted on the guide rod 64. Normally, the guide cone 66 moves down by its own gravity to bear against a stop 64*a* secured to the lower end of the guide rod 64 where it stays at rest. However, when a vessel is being raised, it is carried upward together with the vessel to abut against the bottle mouth stuffing 52.

The operation of the above filling machine will now be described. During a normal filling operation, a low pressure air is normally introduced into the air inlet chamber 62 to hold the cylindrical holder 54, which carries the bottle mouth stuffing 52, urged downward. The cylindrical holder 54 stays at rest by abutment against the upper surface of the guide cone 66 which then assumes its lowermost position where it abuts against the stop 62*a* on the guide rod 64. An air pressure is introduced into the lower pressure chamber 50 within the cylindrical piston 20 while the upper pressure chamber 48 is open to the atmosphere, whereby the cylindrical piston 20 and its integral exhaust pipe 18 are raised to their uppermost positions. Accordingly, the nozzle 26 which is secured to the lower end of the exhaust pipe 18 is contained within the liquid injection pipe 16, with the liquid valve 28 and the air valve 30 both closed. The plunger 34 secured to the top end of the liquid supply tube 12 is inserted into the exhaust pipe 18 to close the exhaust opening 34*a* of the negative pressure generating valve 32.

When a vessel is delivered to the vessel receptacle and is raised as the receptacle is raised, the mouth of the vessel bears against the guide cone 66 to raise it and the bottle mouth stuffing 52 which is carried by the cylindrical holder 54. Since the bottle mouth stuffing 52 is urged downward by the air present within the air inlet chamber 62, the stuffing 52 tightly engages the mouth of the vessel to seal it.

Figure 5:
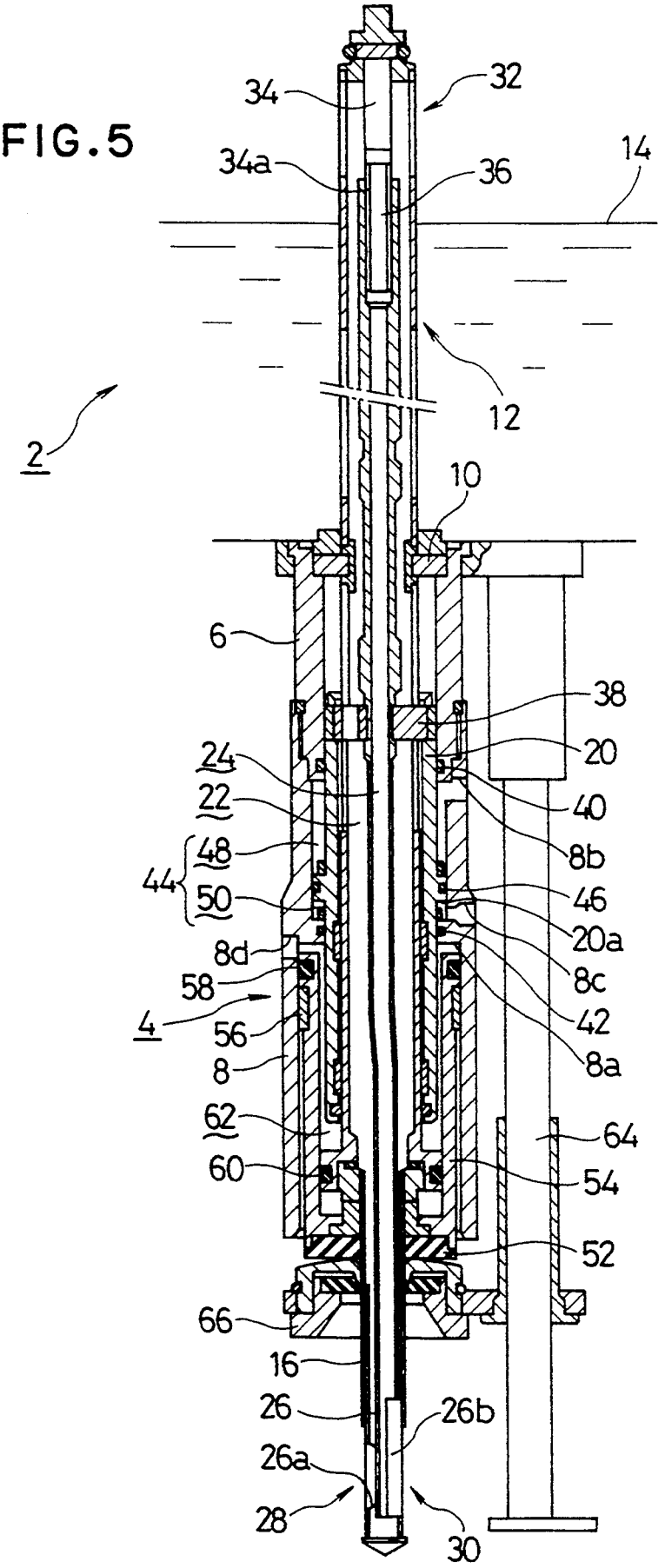
FIG. 5 is an illustration of the operation of the filling head shown in FIG. 4.

Then, the air is introduced into the upper pressure chamber 48 while the lower pressure chamber 50 is released to the atmosphere. Thereupon, the cylindrical piston 20 is depressed, and the exhaust pipe 18 which is connected thereto by means of the connection member 38 and the nozzle 26 secured to the lower end of the exhaust pipe 18 also move down in an integral manner. The downward movement of the exhaust pipe 18 and the nozzle 26 causes a decompression of the interior of the negative pressure generating chamber 36 (it is to be noted that during the initial phase of the downward movement of the exhaust pipe 18, the exhaust opening 34*a* of the valve 32 is closed by the exhaust pipe 18), and the liquid injection port 26*a* of the liquid valve 28 is opened, followed by an opening of the exhaust port 26*b* of the air valve 30. As the exhaust pipe 18 moves further downward, the exhaust opening 34*a* of the valve 32 is opened, with consequence that the air and any residue of liquid which is present within the exhaust pipe 18 is withdrawn into the tank 2 by the action of the negative pressure, thus commencing a filling operation. (FIG. 5 shows such a condition during the filling operation, but the vessel is omitted from illustration.)

As the filling of the vessel proceeds, and the filling liquid reaches the lower end of the liquid injection pipe 16, it then rises through the exhaust pipe 18, and when it reaches the elevation of the liquid level 14 within the tank 2, the filling operation is completed. Subsequently, the supply of air to the upper pressure chamber 48 of the cylindrical piston 20 is interrupted, which is then released to the atmosphere, while the air is introduced into the lower pressure chamber 50. As the cylindrical piston 20 rises, the exhaust pipe 18 and the nozzle 26 also rise, thus closing the liquid injection port 26*a* and the exhaust port 26*b*. Subsequently, the vessel receptacle moves down, and the filled vessel is delivered from the filling machine to be handed to a subsequent step. In the filling machine of this embodiment, the volume of the void within the vessel can be adjusted by merely elevating the tank 2, in the similar manner as in the first mentioned embodiment.

It should be understood that the specific construction illustrated in the both embodiments are not essential to the present invention, which may be practiced by utilizing an alternative construction. At any event, all that is required to achieve the described result is that the bottle mouth stuffing be separated from the liquid injection pipe and the exhaust pipe which open or close the liquid valve by its relative elevating movement, and be made elevatable independently and that the tank containing a supply of a filling liquid be elevatable.

Figure 6:
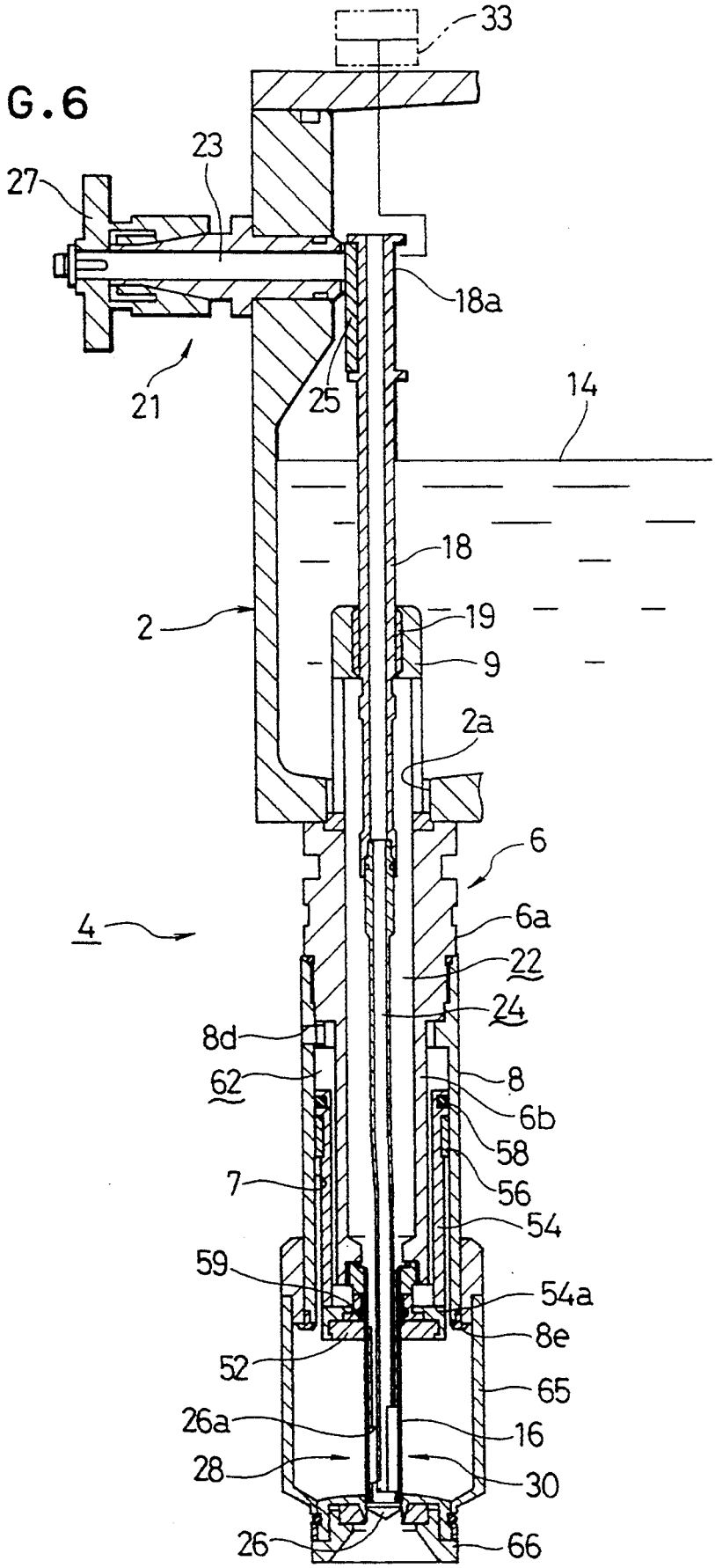
FIG. 6 is a longitudinal section of a further form of filling head which is utilized in a filling machine according to another embodiment of the invention which is provided with an arrangement for discharging a residue of liquid from within an exhaust pipe.

Now referring to FIG. 6, another form of filling head 4 according to a third embodiment of the invention will be described. A filling machine which is provided with the filling head 4 of this embodiment is also provided with a void controller similar to that shown in the described embodiments, and is also provided, according to another feature of the present invention, with an arrangement for enabling a discharge of any residue of liquid which remains within an exhaust pipe at the commencement of the filling operation. Accordingly, corresponding parts to those used in the first embodiment are designated by like numerals as before, and will not be described.

In this embodiment, an upper housing 6 also includes a top portion 6*a* of an increased diameter and a bottom portion 6*b* of a reduced diameter, and a clearance 7 is defined between the outer peripheral surface of the bottom portion 6*b* and the inner peripheral surface of a lower housing 8, and a cylindrical holder 54 having a bottle mouth stuffing 52 mounted on its lower end is fitted in this clearance, and slides along the internal surface of the lower housing 8 with a slide bushing 56 interposed therebetween. The bottle mouth stuffing 52 is mounted on a lower portion 54*a* of the cylindrical holder 54, which slides along the external surface of a liquid injection pipe 16. A seal ring 58 is mounted on the external surface of the cylindrical holder 54 at its top end, and an O-ring 59 is mounted around the internal surface of the bottom portion 54*a* to achieve a hermetic seal. The external surface of the bottom portion 6*b* of the upper housing 6, the lower housing 8 and the cylindrical holder 54 constitute together an air inlet chamber 62. Toward its top end, the wall of the lower housing 8 is formed with an air inlet port 8*d* communicating with the air inlet chamber 62, which is in turn connected to an air source through a switching valve, not shown. By a switching action of the switching valve, air may be introduced into the chamber 62, or alternatively, the air may be interrupted, and the chamber 62 may be made open to the atmosphere. The pressure of the air which is introduced into the chamber 62 is effective, by acting through the cylindrical holder 54, to urge the bottle mouth stuffing 52 downward, but is of a low pressure which allows the stuffing 52 to tightly engage the mouth of a vessel which is carried upward by the vessel receptacle.

An elevating sleeve 65, which is similar to that described in connection with the first embodiment, is fitted around the lower housing 8 for elevating movement, and a guide cone 66 for centering a vessel as it is carried upward upon the vessel receptacle 3 is mounted on the lower end of the elevating sleeve 65. In the present embodiment, the elevating sleeve 65 normally moves down by its own gravity to bear against a stop 8*e* where it stays at rest.

The operation of the described filling machine will be described. At the commencement of a filling operation, the elevating lever 25 of the exhaust pipe elevating mechanism 21 is turned upward, whereby the exhaust pipe 18 assumes its raised position, and the nozzle 26 which is secured to the lower end of the exhaust pipe is received within the liquid injection pipe 16, thus closing the liquid valve 28 and the air valve 30. The air inlet chamber 62 is interrupted from the air source by a switching valve, but is left open to the atmosphere.

As the vessel receptacle is raised by the action of the cam 5, the vessel on the receptacle begins to rise as guided by the guide cone 66. At the upper end of the stroke of the vessel receptacle, the mouth of the vessel bears against the upwardly located bottle mouth stuffing 52 through the interposed guide cone 66.

Subsequently, as the operating lever 27 is turned, the rotary shaft 23 and the elevating lever 25 are rotated together, depressing the exhaust pipe 18. When the exhaust pipe 18 and the nozzle 26 move down relative to the upper housing (liquid supply tube) 6 and the liquid injection pipe 16, the liquid valve 28 and the air valve 30 are opened. The opening of the liquid valve 28 allows the liquid contained within the tank 2 to begin to flow into the vessel. Since the air inlet chamber 62 which urges the bottle mouth stuffing 52 downward is left open to the atmosphere, there is no force acting which causes the bottle mouth stuffing 52 to tightly engage the mouth of the vessel, and accordingly the air present within the vessel finds its way out through a gap between the stuffing 52 and the mouth of the vessel as the liquid flows into the vessel. Any residue of liquid which remains in the exhaust pipe 18 also flows into the vessel. Also in this embodiment, it is to be noted that means for elevating the exhaust pipe 18 is not limited to the one shown, but the exhaust pipe 18 may be elevated as by an actuator 33 (shown in phantom line in FIG. 6) disposed on top of the tank 2.

When any residue of liquid which remains within the exhaust pipe 18 is discharged and the filling operation can take place smoothly, the switching valve is operated to introduce the air into the air inlet chamber 62. The air pressure urges the cylindrical holder 54 down, whereby the bottle mouth stuffing 52 is urged through the interposed guide cone 66, against the mouth of the vessel to seal it. Subsequently, the filling liquid finds its way from the liquid passage 22 through the liquid injection port 26*a* into the vessel while the air present within the vessel is exhausted through the exhaust opening in the nozzle 26 and through the exhaust passage 24 into the tank 2, thus assuring a normal filling operation.

When the filling of the vessel proceeds, and the liquid fills the liquid injection pipe 16 to its lower end, the liquid then enters the exhaust opening and rises upward through the exhaust pipe 18, and when it reaches the liquid level 14 within the tank 2, the inflow of the filling liquid into the vessel is completed. Subsequently, the operating lever 27 of the exhaust pipe elevating mechanism 21 is turned, causing the elevating lever 25 to raise the exhaust pipe 18 upward. As the exhaust pipe 18 is raised, the liquid valve 28 and the air valve 30 are closed. Then follows an operation of the switching valve, which makes the air inlet chamber 62 open to the atmosphere. The vessel receptacle 3 moves down, and the filled vessel is delivered onto the conveyor 70 through the delivery star wheel 74, thus completing a filling step. It is to be understood that means for urging the cylindrical holder 54 down is not limited to pneumatic means shown, but any other means may be provided which is effective to provide an urging action and to terminate such urging action.

It will be appreciated that the timing when the liquid injection valve 28 is opened by causing the exhaust pipe elevating mechanism 21 to raise the exhaust pipe 18 is offset from the timing when the bottle mouth stuffing 52 is brought into abutment against the mouth of the vessel by introducing the air into the air inlet chamber 62. Such offset in the timing is effective to prevent the vessel from being sealed during the initial phase of the filling operation, whereby the air present within the vessel can freely finds its way out. This allows any residue of liquid which remains within the exhaust pipe 18 at the completion of the previous filling operation to freely fall into the vessel, and accordingly, the filling operation can take place immediately and rapidly upon commencement of the filling operation. In addition, this arrangement avoids the use of a plunger, as in the prior art, for generating a negative pressure in order to allow any residue of liquid remaining within the exhaust pipe 18 to be discharged, and is favorable in sanitary respect and also reduces the cost involved. Finally, since the filling operation takes place immediately upon opening the liquid valve, the filling speed can be increased, allowing the number of filling heads 4 used to be reduced to reduce in turn the size of the overall arrangement for a filling machine of the same capacity. As before, the volume of a void which remains in the top of the vessel after the completion of the filling operation can be adjusted in a simple manner.

Figure 7:
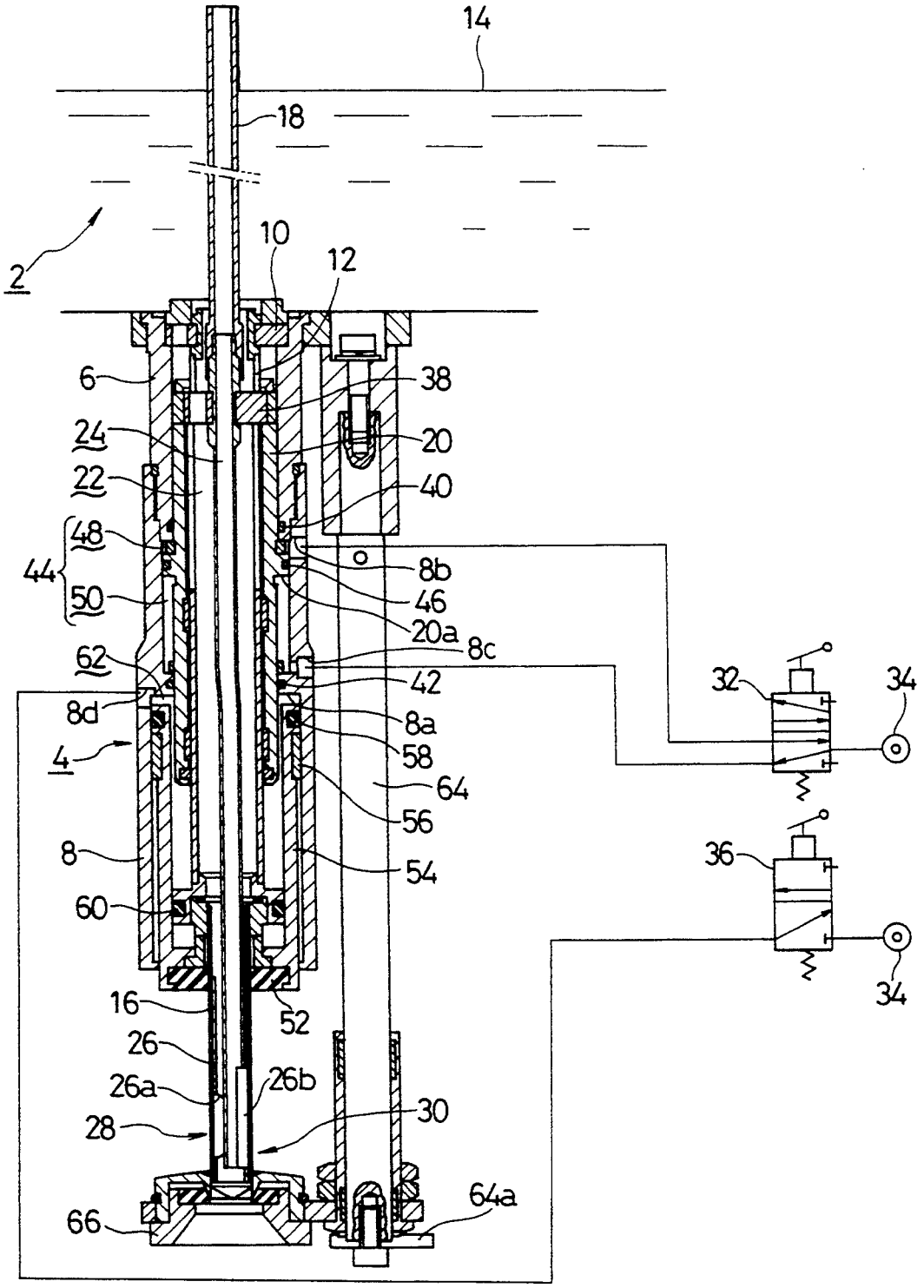
FIG. 7 is a longitudinal section of yet another form of filling head.

Referring to FIG. 7, a different form of filling head 4 according to a fourth embodiment of the invention will be described. A pair of cylindrical housings 6, 8 which are vertically coupled together are secured to the bottom surface of the tank 2, and a liquid supply tube 12 is fixedly mounted within the housings 6, 8 by utilizing a bracket 10. Unlike the second embodiment mentioned above, in the present embodiment, the tube 12 does not include a top portion which extends into the tank 2. A liquid injection pipe 16 of a reduced diameter is secured to the lower end of the tube 12, and an exhaust pipe 18 passes through the tube 12 and the pipe 16, and is connected to a cylindrical piston 20, to be described later, for integral elevating movement therewith. The top of the exhaust pipe 18 extends upward into the tank 2, and projects above the liquid level 14 of the filling liquid. A filling liquid passage 22 is defined between the external surface of the exhaust pipe 18 and the internal surfaces of the liquid supply tube 12 and the liquid injection pipe 16, while an exhaust passage 24 is defined by the interior of the exhaust pipe 18.

The cylindrical piston 20 is formed with an annular projection **20*a*, which represents a partition between a pair of pressure chambers 48, 50 each including an air inlet port 8*b* or 8*c* and which are connected to an air source 34 through a switching valve 32. While the switching valve 32 and the source 34 have not been illustrated in the second embodiment, they are similarly constructed. The valve 32 operates to introduce the air into one of the pressure chambers 48, 50 and communicate the other to the atmosphere. Such switching action is effective to elevate, namely, raise or lower the cylindrical piston 20 and hence the exhaust pipe 18 which is connected to the cylindrical piston 20**.

The wall of the lower housing 8 is formed with an air inlet port **8*d* which communicates with an air inlet chamber 62, which is in turn connected to the source 34 through a second switching valve 36. Such valve 36** has not been shown in the description of the second embodiment.

As the second switching valve 36 is operated, the air is introduced into the chamber 62, or the air is interrupted, and the chamber 62 is made to communicate with the atmosphere. The air pressure introduced into the chamber 62 is effective, acting through the cylindrical holder 54, to urge the bottle mouth stuffing 52 downward, but is of a low pressure which allows it to tightly engage the mouth of a vessel which is being raised as carried upon a vessel receptacle.

Figure 8:
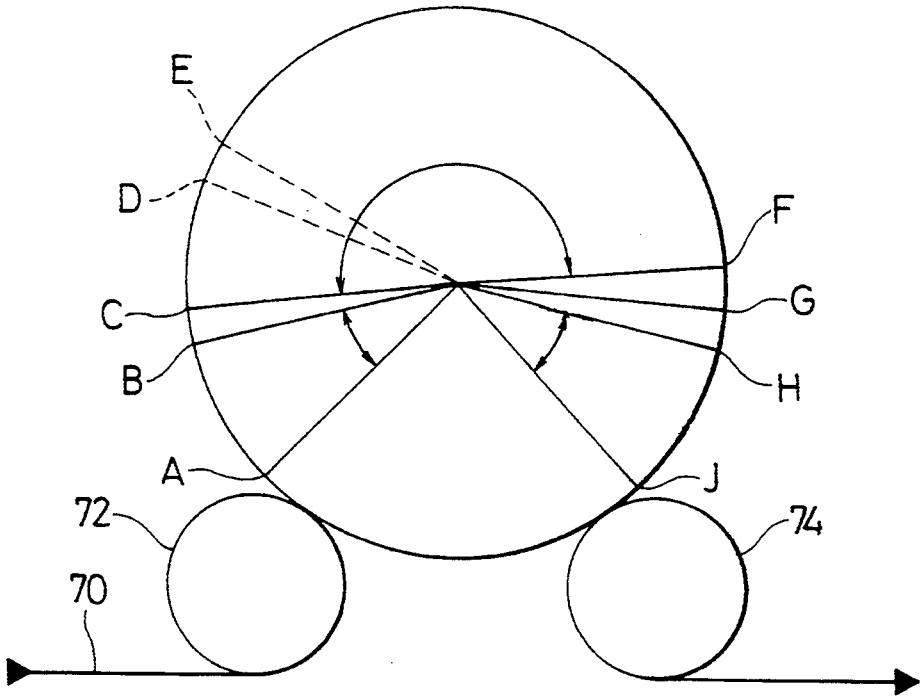
FIG. 8 is a schematic plan view, illustrating the operation of the filling machine which is provided with a filling head constructed as per the embodiment shown in FIG. 7.

The operation of this filling machine will be described with reference to FIG. 8. Initially, upon commencement of a filling operation, the first switching valve 32 is operated to introduce a pressure air into the lower pressure chamber 50 of the cylindrical piston 20 while the upper pressure chamber 48 is open to the atmosphere, thus allowing the cylindrical piston 20 and its connected exhaust pipe 18 to be raised while maintaining the liquid valve 28 and the air valve 30 closed. The second switching valve 36 makes the air inlet chamber 62 open to the atmosphere.

A vessel which is conveyed on the conveyor 70 is delivered by the supply star wheel 72 onto a vessel receptacle within the filling machine. The vessel receptacle begins to be raised at position A while rotating together with the tank 2 and the filling head 4, and the rising motion continues to position B. In the meantime, a vessel placed on the receptacle is raised as its mouth is guided by the guide cone 66. At the elevated position of the vessel receptacle, the mouth of the vessel contacts the upwardly positioned bottle mouth stuffing 52 through the guide cone 66. When the receptacle and the filling head 4 reach the position B, the first switching valve 32 is operated to make the lower pressure chamber 50 to be opened to the atmosphere while a pressure air is introduced into the upper pressure chamber 48. As a result of such action, the exhaust pipe 18 is forced down by a drive transmitted through the cylindrical piston 20, thus opening both the liquid valve 28 and the air valve 30. The opening operation of the both valves 28, 30 under the influence of the switching valve 32 is initiated at position B and is completed before position C is reached.

When the liquid valve 28 is open, the liquid contained in the tank 2 begins to flow into the vessel. Since the air inlet chamber 62 which urges the bottle mouth stuffing 52 downward is open to the atmosphere, there is no force acting to hold the bottle mouth stuffing 52 in tight engagement with the mouth of the vessel, so that as the liquid flows into the vessel, the air present therein can find its way out through a gap therebetween. Any residue of liquid which remains in the exhaust pipe 18 is also allowed to flow into the vessel.

A filling operation is initiated at position C, and when position D is reached, the second switching valve 36 is operated to introduce the air into the air inlet chamber 62. The switching operation of the switching valve 36 is completed by the time position E is reached, whereby the bottle mouth stuffing 52 is held in abutment against the mouth of the vessel through the interposed guide cone 66, thus sealing the vessel. Subsequently, the filling liquid flows into the vessel through the liquid passage 22 and the liquid injection port **26*a* disposed within the liquid injection pipes 12, 16 while the air present in the vessel is exhausted into the tank 2** to achieve a normal filling operation until position F is reached.

As the filling of the vessel proceeds and the position F is reached, the first switching valve 32 is operated to make the upper pressure chamber 48 open to the atmosphere while the air is introduced into the lower pressure chamber 50. As a consequence, the cylindrical piston 20 and the exhaust pipe 18 are raised, thus closing the liquid valve 28 and the air valve 30. The switching action of the first switching valve 32 is completed at a point between positions F and G, thus completing the filling operation. At position G, the switching action of the second switching valve 36 is initiated substantially simultaneously with the completion of the switching action of the first switching valve 32, thus making the air inlet chamber 62 open to the atmosphere. The switching action of the valve 36 is completed at a point between positions G and H, thus terminating the force which has caused the bottle mouth stuffing 52 to abut against the mouth of the vessel. Subsequently, during an interval indicated between positions H and J, the vessel receptacle moves down, and the vessel which is filled with the liquid is delivered by the delivery star wheel 74 onto the conveyor 70 to be carried to a succeeding step. When the second switching valve 36 is switched to make the air inlet chamber 62 open to the atmosphere, the holder 54 which holds the bottle mouth stuffing 52 does not move down, but stays at the position illustrated in FIG. 7 due to a frictional resistance presented by the seal ring 58 mounted on its external surface and of the seal ring 60 mounted on the liquid injection pipe 16 and disposed in sliding contact with the internal surface of the holder.

It will be appreciated that the timing when the liquid injection valve 28 is opened by the first valve 32 is offset from the timing when the bottle mouth stuffing 52 is brought into abutment against the mouth of a vessel by the action of the second valve 36. Such offset in the timing is effective, during an initial phase (from position C to position D) of a filling zone (from position C to position F) where a filling of the vessel takes place, to prevent the vessel from being sealed, and accordingly the air present within the vessel is free to find its way out, thus allowing a free fall into the vessel of any residue of liquid which may have remained within the exhaust pipe 18 at the completion of the previous filling operation, and thus allowing an immediate and rapid filling operation to be initiated. The use of a plunger which has been used in the prior art in order to generate a negative pressure which is utilized to discharge any residue of liquid from within the exhaust pipe 18 is avoided in accordance with the invention, and hence the arrangement of the present invention is favorable in sanitary respect and reduces the involved cost. In addition, since the filling operation takes place immediately upon opening the liquid valve, the filling speed can be increased, thus allowing the number of filling heads 4 required to be reduced for a filling machine of the same capacity and thereby allowing the size of the overall arrangement to be reduced.

A filling of the vessel takes place in a manner such that when the liquid fills the liquid injection pipe 16 to its lower end, the liquid then enters the exhaust port **26*b* to rise within the exhaust pipe 18, and when it reaches the liquid level 14 within the tank 2, the filling operation is completed. Accordingly, it is essential that the bottle mouth stuffing 52 tightly bears against the vessel at this point in time (or position F). Stated differently, it is only necessary that the vessel be sealed by the bottle mouth stuffing 52 only when the filling operation is to be completed, so that by switching the second valve 36, the timing when the air pressure is introduced into the air inlet chamber 62** may be delayed to a point downstream of the position D, thereby facilitating the exhaust of the air from within the vessel and further accelerating the filling operation.

As before, it should be noted that the construction of the third and the fourth embodiment is not limited to those shown, but may be substituted by alternative constructions or modified in various manners. At any rate, the described advantage of the invention can be achieved by employing an arrangement in which the bottle mouth stuffing be separate from the liquid injection pipe and the exhaust pipe which open or close the liquid valve, and be elevatable independently therefrom and can be urged down as by introducing the air pressure, and that the timing where the stuffing is brought into abutment against the mouth of the vessel is selectable.

While the invention has been illustrated and disclosed above in connection with several embodiments thereof, it should be understood that a number of changes and modifications therein are possible by one skilled in the art from the above disclosure without departing from the spirit and scope of the invention defined by the appended claims.

What is claimed is:

1. A filling machine with a controller for adjusting a liquid level in a vessel, comprising a tank containing a supply of a filling liquid, a hollow tubular body fixedly secured to and extending downwardly from a bottom surface of the tank, a liquid injection pipe fixedly mounted to and extending downwardly from a bottom surface of the tubular body, the tubular body and the liquid injection pipe having an internal liquid passage formed therein which conveys the filling liquid from the tank to the vessel positioned below the injection pipe, an exhaust pipe elevatably disposed within the internal liquid passage and having an internal exhaust passage formed therein which vents exhaust from the vessel, means for elevating the exhaust pipe relative to the liquid injection pipe, a liquid valve which dispenses the filling liquid from the internal liquid passage to the vessel and an air valve which vents the exhaust from the vessel into the internal exhaust passage, the liquid valve and the air valve being formed in a bottom portion of the exhaust pipe and adapted to be opened or closed in response to an elevating movement of the exhaust pipe relative to the liquid injection pipe, a holder elevatably surrounding the liquid injection pipe and a lower portion of the tubular body and having a bottle mouth stuffing mounted on a lower end of the holder, the bottle mouth stuffing adapted to sealingly engage a mouth of the vessel, means for urging the holder down in a lower position relative to the liquid injection pipe, means for elevating the vessel to cause the mouth thereof to tightly engage the bottle mouth stuffing, and means for varying a distance between a free end of the liquid injection pipe and the bottle mouth stuffing to effect a change in volume of a void at an upper end portion of the vessel and thus effect a change in the liquid level in the vessel, the means for varying including means for elevating the tank.

2. A filling machine according to claim 1, in which the means for urging the holder comprises an air inlet chamber sealingly formed in the top of the holder, and means for supplying air to the air inlet chamber.

3. A filling machine according to claim 1, in which the means for urging the holder comprises a spring.

4. A filling machine with a controller for adjusting a liquid level in a vessel, comprising a tank containing a supply of a filling liquid, a hollow tubular housing fixedly secured to and extending downwardly from a bottom surface of the tank, a liquid supply tube fixedly mounted to and extending within the housing, a liquid injection pipe fixedly mounted to and extending downwardly from a bottom surface of the liquid supply tube, the liquid supply tube and the liquid injection pipe conveying the filling liquid from the tank to the vessel positioned below the liquid injection pipe, an elevatable exhaust pipe disposed within the liquid supply tube and the liquid injection pipe which vents exhaust from the vessel, means for elevating the exhaust pipe relative to the liquid injection pipe, a liquid valve for dispensing the filling liquid from the liquid injection pipe into the vessel and an air valve for venting the exhaust from the vessel into the exhaust pipe, both the liquid valve and the air valve being formed in a bottom portion of the exhaust pipe and adapted to be opened and closed in response to an elevating movement of the exhaust pipe relative to the liquid injection pipe, a holder elevatably disposed within a lower portion of the housing and elevatably surrounding the liquid injection pipe, the holder having a bottle mouth stuffing mounted on a lower end of the holder which is adapted to sealingly engage a mouth of the vessel, means for urging the holder down in a lower position relative to the liquid injection pipe, means for elevating the vessel to bring the mouth thereof into tight engagement with the bottle mouth stuffing, and means for varying a distance between a free end of the liquid injection pipe and the bottle mouth stuffing to effect a change in volume of a void at an upper end portion of the vessel and thus effect a change in the liquid level in the vessel, the means for varying including means for elevating the tank.

5. A filling machine with a controller for adjusting a liquid level in a vessel, comprising a tank containing a supply of a filling liquid, a hollow tubular housing fixedly secured to and extending downwardly from a bottom surface of the tank, a liquid supply tube fixedly mounted to and extending within the housing, a liquid injection pipe fixedly mounted to and extending downwardly from a bottom surface of the liquid supply tube, the liquid supply tube and the liquid injection pipe conveying the filling liquid from the tank to the vessel positioned below the liquid injection pipe, a cylindrical piston fitted between an internal surface of the housing and an external surface of the liquid supply tube in an elevatable manner, an exhaust pipe disposed within the liquid supply tube and the liquid injection pipe which vents exhaust from the vessel, the exhaust pipe being connected to the cylindrical piston for integral elevating movement therewith, a pair of upper and lower pressure chambers defined between the internal surface of the housing and an external surface of the cylindrical piston, means for introducing an air pressure into one of the pressure chambers to elevate the piston, a liquid valve for dispensing the filling liquid from the liquid injection pipe into the vessel and an air valve for venting the exhaust from the vessel into the exhaust pipe, both the liquid valve and the air valve being formed in a bottom portion of the exhaust pipe and adapted to be opened and closed in response to an elevating movement of the exhaust pipe relative to the liquid injection pipe, a holder elevatably disposed within a lower portion of the housing and elevatably surrounding the liquid injection pipe, the holder having a bottle mouth stuffing mounted on a lower end of the holder which is adapted to sealingly engage a mouth of the vessel, means for urging the holder down in a lower position relative to the liquid injection pipe, means for elevating the vessel to bring the mouth thereof into tight engagement with the bottle mouth stuffing, and means for elevating the tank to vary a distance between a free end of the liquid injection pipe and the bottle mouth stuffing which effects a change in volume of a void at an upper end portion of the vessel and thus effects a change in the liquid level in the vessel.

6. A filling machine with an arrangement for discharging a liquid residue which remains within an exhaust pipe, comprising a tank containing a supply of a filling liquid, a hollow tubular body fixedly secured to and extending downwardly from a bottom surface of the tank, a liquid injection pipe fixedly mounted to and extending downwardly from a bottom surface of the tubular body, the tubular body and the liquid injection pipe having an internal liquid passage formed therein which conveys the filling liquid from the tank to the vessel positioned below the injection pipe, the exhaust pipe being elevatably disposed within the internal liquid passage and having an internal exhaust passage formed therein which vents exhaust from the vessel, means for elevating the exhaust pipe relative to the liquid injection pipe, a liquid valve which dispenses the filling liquid from the interlab liquid passage to the vessel and an air valve which vents the exhaust from the vessel into the internal exhaust passage, the liquid valve and the air valve being formed in a bottom portion of the exhaust pipe and adapted to be opened and closed in response to an elevating movement of the exhaust pipe relative to the liquid injection pipe, a holder elevatably surrounding the liquid injection pipe and a lower portion of the tubular body and having a bottle mouth stuffing mounted on a lower end of the holder, the bottle mouth stuffing adapted to sealingly engage a mouth of the vessel, means for urging the holder down in a lower position relative to the liquid injection pipe to bring the bottle mouth stuffing into tight engagement with the mouth of the vessel in delayed relationship to the opening of the liquid and air valves so that the liquid residue remaining within the exhaust passage is permitted to drain into the vessel before the stuffing is urged into tight engagement with the mouth, and means for elevating the vessel to bring the mouth thereof into abutment against the bottle mouth stuffing.

7. A filling machine according to claim 6, wherein the means for urging the holder includes an air inlet chamber sealingly formed in a top portion of the holder, and wherein a switching means is provided for selectably connecting and disconnecting the air inlet chamber to and from an air source.

8. A filling machine with an arrangement for discharging a liquid residue which remains within an exhaust pipe, comprising a tank containing a supply of a filling liquid, a hollow tubular housing fixedly secured to and extending downwardly from a bottom surface of the tank, a liquid supply tube fixedly mounted to and extending within the housing, a liquid injection pipe fixedly mounted to and extending downwardly from a bottom surface of the liquid supply tube, the liquid supply tube and the liquid injection pipe conveying the filling liquid from the tank to the vessel positioned below the liquid injection pipe, the exhaust pipe being elevatably disposed within the liquid supply tube and the liquid injection pipe and vents exhaust from the vessel, means for elevating the exhaust pipe relative to the liquid injection pipe, a liquid valve for dispensing the filling liquid from the liquid injection pipe into the vessel and an air valve for venting the exhaust from the vessel into the exhaust pipe, the liquid valve and the air valve being formed in a bottom portion of the exhaust pipe and adapted to be opened and closed in response to an elevating movement of the exhaust pipe relative to the liquid injection pipe, a holder disposed within a lower portion of the housing and elevatably surrounding the liquid injection pipe, the holder having a bottle mouth stuffing mounted on a lower end of the holder which is adapted to sealingly engage a mouth of the vessel, means for urging the holder down in a lower position relative to the liquid injection pipe to bring the bottle mouth stuffing into tight engagement with the mouth of the vessel in delayed relationship to the opening of the liquid and air valves so that the liquid residue remaining within the exhaust passage is permitted to drain into the vessel before the stuffing is urged into tight engagement with the mouth, the means for urging including an air inlet chamber defined between an internal surface of the housing and an upper portion of the holder and means for supplying air to the air inlet chamber to urge the holder down into the lower position, and means for elevating the vessel to bring the mouth thereof into abutment against the bottle mouth stuffing.

9. A filling machine according to claim 8, wherein the means for elevating the exhaust pipe comprises a cylindrical piston fitted between the internal surface of the housing and an external surface of the liquid supply tube in an elevatable manner and connected to the exhaust pipe for integral elevating movement therewith, a pair of upper and lower partitioned pressure chambers defined between the internal surface of the housing and an external surface of the cylindrical piston, and means for introducing air pressure into one of the pressure chambers to elevate the piston.

10. A filling machine with an arrangement for discharging a liquid residue which remains within an exhaust pipe, comprising a tank containing a supply of a filling liquid, a hollow tubular body fixedly secured to and extending downwardly from a bottom surface of the tank, a liquid injection pipe fixedly mounted to and extending downwardly from a bottom surface of the tubular body, the tubular body and the liquid injection pipe having an internal liquid passage formed therein which conveys the filling liquid from the tank to the vessel positioned below the injection pipe, the exhaust pipe being elevatably disposed within the internal liquid passage and having an internal exhaust passage formed therein which vents exhaust from the vessel, means for elevating the exhaust pipe relative to the liquid injection pipe, a liquid valve which dispenses the filling liquid from the internal liquid passage to the vessel and an air valve which vents the exhaust from the vessel into the internal exhaust passage, the liquid valve and the air valve being formed in a bottom portion of the exhaust pipe and adapted to be opened and closed in response to an elevating movement of the exhaust pipe relative to the liquid injection pipe, a holder elevatably surrounding the liquid injection pipe and a lower portion of the tubular body and having a bottle mouth stuffing mounted on a lower end of the holder, the bottle moth stuffing adapted to sealingly engage a mouth of the vessel, means for urging the holder down in a lower position relative to the liquid injection pipe to bring the bottle mouth stuffing into tight engagement with the mouth of the vessel in delayed relationship to the opening of the liquid and air valves so that the liquid residue remaining within the exhaust passage is permitted to drain into the vessel before the stuffing is urged into tight engagement with the mouth, means for elevating the vessel to bring the mouth into abutment against the bottle mouth stuffing, and means for varying a distance between a free end of the liquid injection pipe and the bottle mouth stuffing to effect a change in volume of a void at an upper end portion of the vessel and thus effect a change in the liquid level in the vessel, the means for varying including means for elevating the tank.

* * * * *

UNITED STATES PATENT AND TRADEMARK OFFICE

CERTIFICATE OF CORRECTION

PATENT NO. : 5,372,167

DATED : December 13, 1994

INVENTOR(S) : Hideaki Hirose et al.

It is certified that error appears in the above-indentified patent and that said Letters Patent is hereby corrected as shown below:

Column 18, line 19; change "interlab" to ---internal---.

Column 20, line 18; change "moth" to ---mouth---.

Signed and Sealed this

Twenty-third Day of May, 1995

*Attest:*

Bruce Lehman

BRUCE LEHMAN

*Attesting Officer*

*Commissioner of Patents and Trademarks*